US006706242B2

(12) United States Patent
Takasaki et al.

(10) Patent No.: US 6,706,242 B2
(45) Date of Patent: Mar. 16, 2004

(54) HEAT RESISTANT AL DIE CAST MATERIAL

(75) Inventors: Norimasa Takasaki, Wako (JP); Yuuko Yoshimura, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/108,527

(22) Filed: Mar. 27, 2002

(65) Prior Publication Data

US 2003/0047250 A1 Mar. 13, 2003

(30) Foreign Application Priority Data

Mar. 28, 2001 (JP) ..... 2001-094368

(51) Int. Cl.[7] ..... C22C 21/02

(52) U.S. Cl. ..... 420/532; 420/534; 420/535; 148/417

(58) Field of Search ..... 420/532, 534, 420/535; 148/417

(56) References Cited

U.S. PATENT DOCUMENTS 4,834,941 A 5/1989 Shiina ..... 420/532

OTHER PUBLICATIONS

"Metals Handbook: Desk Edition", 2[nd] ed, Davis, J. R., ASM International, 1998, p 484.*

* cited by examiner

*Primary Examiner*—George Wyszomierski
*Assistant Examiner*—Janelle Morillo
(74) *Attorney, Agent, or Firm*—Adams & Wilks

(57) ABSTRACT

Heat resistant Al die cast material having 12.5% to 14.0% of Si, 3.0% to 4.5% of Cu, 1.4% to 2.0% of Mg, and 1.12% to 2.4% of Zn. The die cast metal becomes amenable to age hardening treatment when appropriate amounts of Mg and Zn are added to an Al—Si—Cu alloy for enhancing mechanical strength and seizure characteristics.

20 Claims, 2 Drawing Sheets

INVENTIVE SAMPLE 3
INVENTIVE SAMPLE 2
REFERENCE SAMPLE 3
PV VALUE
30
25
20
15
10
5
0
100
1000
1200
10
5
3
TIME (Sec.)

HEAT RESISTANT AL DIE CAST MATERIAL

FIELD OF THE INVENTION

The present invention relates generally to a heat resistant Al die cast material and, more particularly, to a heat resistant Al die cast material suited as a part of an internal combustion system, such as a piston.

BACKGROUND OF THE INVENTION

Conventional heat resistant Al materials consist of elements like Si, Cu, Mg, Ni and Ti added to Al at concentration levels appropriate for abrasion resistance, seizure resistance, and thermal resistance. An important application for heat resistant Al materials is pistons, which are a part of internal combustion systems. "Al alloy cast metal" is standardized in JIS H 5202 (1992). Table 1 in this standard lists the types of alloys and their codes, Table 2 lists chemical compositions, and Table 3 lists mechanical properties of cast metal test samples. Table 1 through Table 3 below summarize the JIS Table 1 through Table 3.

TABLE 1

| Codes | Types of Alloy | Types of Mold | Comments: Alloy Characteristics | Comments: Applications |
|---|---|---|---|---|
| AC8A | Al-Si-Cu-Ni-Mg | metal mold | temperature and abrasion resistant small coefficient of expansion high tensile strength | automotive diesel engine piston naval piston pulley bearings |
| AC8B | Al-Si-Cu-Ni-Mg | metal mold | same as above | automotive piston pulley bearings |
| AC8C | Al-Si-Cu-Ni-Mg | metal mold | same as above | automotive piston pulley bearings |

As shown in the right-hand column in Table 1, under the "Applications" header, the AC8A, AC8B and AC8C Al alloy die cast metals are used for pistons in automobiles.

"Metal molds" listed under the "Type of Mold" in the third column of Table 1 represent regular metal casting.

TABLE 2

Unit: %

| Codes | Chemical Compositions: Cu | Si | Mg | Zn | Fe | Mn | Ni | Ti | Pb | Sn | Cr | Al |
|---|---|---|---|---|---|---|---|---|---|---|---|---|
| AC8A | 0.8–1.3 | 11.0–13.0 | 0.7–1.3 | ≦0.15 | ≦0.8 | ≦0.15 | 0.8–1.5 | ≦0.20 | ≦0.05 | ≦0.05 | ≦0.10 | Balance |
| AC8B | 2.0–4.0 | 8.5–10.5 | 0.50–1.5 | ≦0.50 | ≦1.0 | ≦0.50 | 0.10–1.0 | ≦0.20 | ≦0.10 | ≦0.10 | ≦0.10 | Balance |
| AC8C | 2.0–4.0 | 8.5–10.5 | 0.50–1.5 | ≦0.50 | ≦1.0 | ≦0.50 | ≦0.50 | ≦0.20 | ≦0.10 | ≦0.10 | ≦0.10 | Balance |

Table 2 shows the chemical compositions of the AC8A, AC8B and AC8C Al alloy die cast materials. AC8A is an Al—Si—Cu—Ni—Mg alloy containing 0.8% to 1.3% Cu, 11.0% to 13.0% Si, 0.7% to 1.3% Mg, and 0.8% to 1.5% Ni. AC8B is an Al—Si—Cu—Ni—Mg alloy containing 2.0% to 4.0% Cu, 8.5% to 10.5% Si, 0.5% to 1.5% Mg, and 0.1% to 1.0% Ni. AC8C is an Al—Si—Cu—Ni—Mg alloy containing 2.0% to 4.0% Cu, 8.5% to 10.5% Si, 0.5% to 1.5% Mg and 0.5% to 1.5% Ni.

As shown in Table 2, Zn content is less than or equal to 0.15% in AC8A and less than or equal to 0.50% in AC8B and AB8C. "Less than or equal to" means that Zn content can be 0%. In other words, Zn content should not exceed the prescribed amount (0.15% or 0.5%).

TABLE 3

| Types | Codes | Tensile Test: Tensile Strength N/mm$^2$ | Tensile Test: Lengthening % | Brinell Hardness HB (10/500) | Reference Heat Treatment: Annealing Temperature ° C. | Annealing Time h | Solution Treatment Temperature ° C. | Solution Treatment Time h | Solution Treatment Temperature ° C. | Solution Treatment Time h |
|---|---|---|---|---|---|---|---|---|---|---|
| As cast | AC8A-F | ≧170 | — | Appx. 85 | — | — | — | — | — | — |
| Age hardening | AC8A-T5 | ≧190 | — | Appx. 90 | — | — | — | — | Appx. 200 | Appx. 4 |

TABLE 3-continued

| Types | Codes | Tensile Test: Tensile Strength N/mm² | Tensile Test: Lengthening % | Brinell Hardness HB (10/500) | Reference Heat Treatment: Annealing Temperature ° C. | Annealing Time h | Solution Treatment Temperature ° C. | Solution Treatment Time h | Solution Treatment Temperature ° C. | Solution Treatment Time h |
|---|---|---|---|---|---|---|---|---|---|---|
| Solution treatment + age hardening | AC8A-T6 | ≧270 | — | Appx. 110 | — | — | Appx. 510 | Appx. 4 | Appx. 170 | Appx. 10 |
| As cast | AC8B-F | ≧170 | — | Appx. 85 | — | — | — | — | — | — |
| Age hardening | AC8B-T5 | ≧180 | — | Appx. 90 | — | — | — | — | Appx 200 | Appx. 4 |
| Solution treatment + age hardening | AC8B-T6 | ≧270 | — | Appx. 110 | — | — | Appx. 510 | Appx. 4 | Appx. 170 | Appx. 10 |
| As cast | AC8C-F | ≧170 | — | Appx. 85 | — | — | — | — | — | — |
| Age hardening | AC8C-T5 | ≧180 | — | Appx. 90 | — | — | — | — | Appx. 200 | Appx. 4 |
| Solution treatment + age hardening | AC8C-T6 | ≧270 | — | Appx. 110 | — | — | Appx. 510 | Appx. 4 | Appx. 170 | Appx. 10 |

Table 3 lists the mechanical properties of die cast test samples and provides information on whether or not any treatment is applied, and, if so, what type of treatment. For example, the "F" suffix that comes after the AC8A, AC8B and AC8C codes indicates that the alloy has only gone through a casting process. A "T5" suffix indicates that the alloy has been age hardened. A "T6" suffix indicates that the alloy has been age hardened after a solution treatment. For example, the AC8C-T6 alloy in the lower-most row goes through a solution treatment for approximately four hours at approximately 510° C., followed by approximately 10 hours of age hardening at approximately 170° C. The third column on Table 3 lists the tensile strengths. Tensile strength is lower for "F" compared with "T5", while tensile strength is higher for "T6" compared with "T5". Therefore, "T5" or "T6" treatment may be used for enhancing strength. These treatments are also effective for improving the dimensional stability during annealing.

TABLE 4

JIS HS5302 Al Alloy Die Cast
Reference Table 1: Mechanical properties of as-cast die cast test samples

| Types | Codes | Tensile Tests: Tensile Strength N/mm² Average Value | Tensile Strength N/mm² Standard Deviation | Lengthening % Average Value | Lengthening % Standard Deviation |
|---|---|---|---|---|---|
| Type 10 | ADC10 | 245 | 20 | 2.0 | 0.6 |
| Type 12 | ADC12 | 225 | 39 | 1.5 | 0.6 |

Table 4 is a Reference Table 1 found in JIS H 5302 (1990). ADC10 and ADC12 are both Al—Si—Cu alloys, which do not contain Mg. Their compositions are given in JIS H 5302 (1990) and will not be listed here. ADC10 and ADC12 are Al alloy die cast metals whose compositions are different from the AC8A, AC8B and AC8C metals discussed above.

ADC10, which is an as-cast metal, has a tensile strength of 245 N/mm$^2$, as shown in the third column of Table 4. ADC10 has a different composition and a much greater tensile strength than the AC8A-F, AC8B-F and AC8C-F metals mentioned above, whose tensile strengths are greater than or equal to 170 N/mm$^2$. ADC12 exhibits similar properties.

While regular cast metals are produced by gravity casting, die cast metals are manufactured by high pressure casting. High pressure casting results in a more dense casting structure, which also results in higher strength.

The inventors of this invention assumed that it would be possible to achieve a much higher strength by treating die cast metals, if "T5" age hardening on the AC8A alloy increases the tensile strength from 170 N/mm$^2$, to 190 N/mm$^2$, and "T6" solvent treatment, followed by age hardening, increases AC8A's tensile strength from 170 N/mm2 to 270 N/mm$^2$.

The inventors first performed an experiment in which an AC8A die cast metal was manufactured and treated with T6 solution treatment, followed by age hardening.

The resulting AC8A-T6 metal was covered by blisters and unusable. It is believed that the alloy incorporates air and other gases during the casting process and remain in the die cast metal as bubbles. These bubbles expand under 510° C. of heat during solvent treatment and lifted the Al alloy, which was softened under high heat.

Annealing temperature for the T5 age hardening, on the other hand, is around 200° C. Nevertheless, even a die cast AC8A-T5 metal shows blistering to a lesser degree. This experiment has confirmed that the ADC compositions are made different from the AC compositions in the JIS in order to avoid this phenomenon.

SUMMARY OF THE INVENTION

The inventors of this invention, however, believed it would be possible to perform the T5 age hardening on die cast metals with AC compositions by modifying the AC compositions. As a result of various research projects, the inventors discovered compositions that would make the AC die cast metal amenable to the T5 treatment.

This invention provides heat resistant Al die cast material that contains 12.5% to 14.0% of Si, 3.0% to 4.5% of Cu, 1.4% to 2.0% of Mg, and 1.12% to 2.4% of Zn. This die cast material is age hardened after die casting.

Because the die cast material having the above composition is amenable to age hardening, the material offers a much higher mechanical strength and seizure resistance. When Zn content is less than 1.12%, the die cast metal is prone to anneal cracks. When Zn content is more than 2.4%, the material exhibits less toughness. Therefore, Zn content should preferably be 1.12% to 2.4%.

Appropriate amounts of Mg and Zn added to an Al—Si—Cu alloy has resulted in a die cast metal that is amenable to annealing. This type of alloy has not been previously commercialized because the material was too susceptible to anneal cracks—an important consideration for a die cast alloy.

For example, a thick cast metal having the ADC14 "die cast Al alloy" composition (16.0% to 18.0% Si, 4.0% to 5.0% Cu, and 0.45% to 0.65% Mg), defined in JIS H 5302 (1990), tends to show many micro-cracks after casting.

Similarly, an alloy with 14.0% Si, 3.3% Cu, and 1.4% Mg contents also exhibits micro-cracks after casting.

This problem is caused by a reduced eutectic temperature, as low as 536° C., depending on Cu and Mg contents. Because the eutectic temperature is lower, compressive stress concentrates where thick and thin parts of the die cast metal meet with each other before the annealed material becomes strong enough, as the molten metal in the metal cast in the shape of the end product solidifies and shrinks. As a result, the metal exhibits anneal cracks.

Zn has been added in an effort to prevent these micro-cracks. As a result, it was discovered that the eutectic temperature would go up to 547 to 554° C., if equal amounts of Mg and Zn are added to Al at the same time as other elements. Further studies revealed that similar effects would be achieved as long as Zn concentration was 80% to 120% of the Mg content.

BRIEF DESCRIPTION OF THE DRAWINGS

Certain preferred embodiments of the present invention will be described in detail hereinbelow, by way of example only, with reference to the accompanying drawings, in which.

DETAILED DESCRIPTION OF THE PREFERRED EMBODIMENTS

Figure 1:
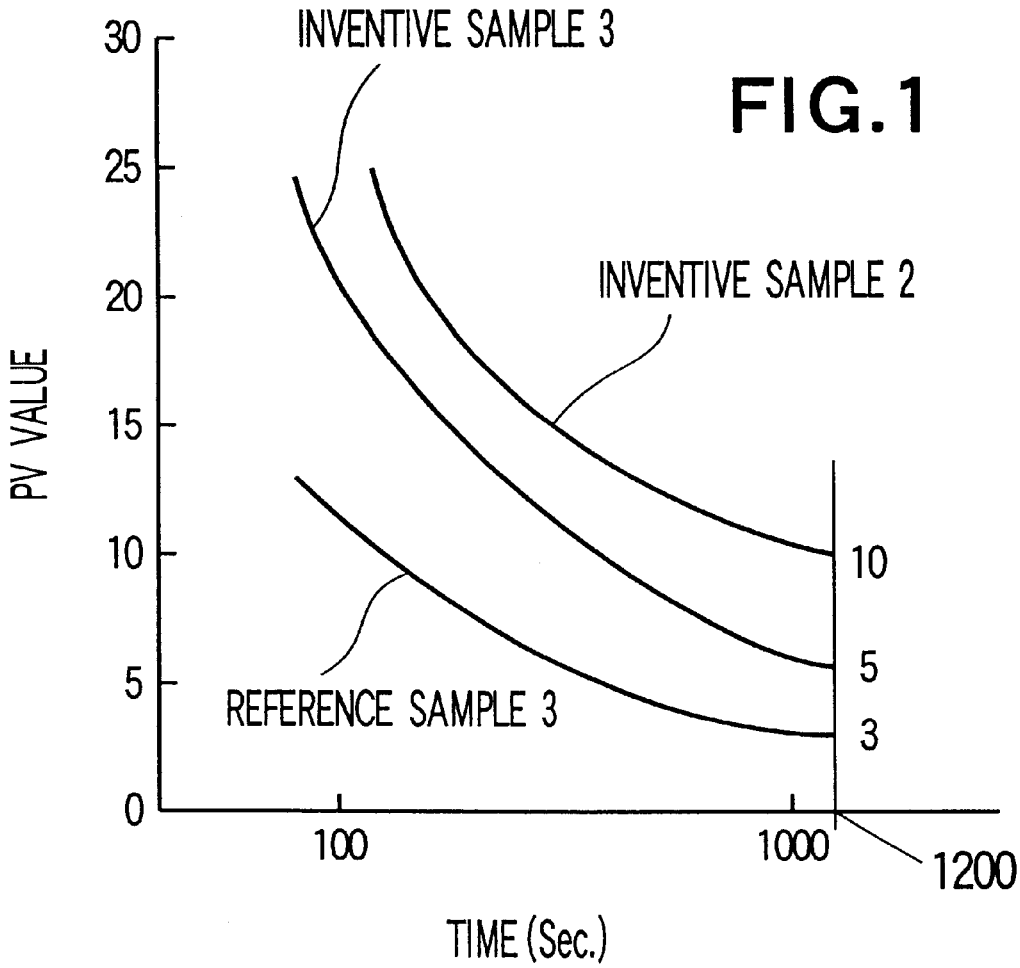
FIG. 1 is a graph showing seizure characteristics of the die cast metal of this invention

The following description is merely exemplary in nature and is in no way intended to limit the invention, its application or uses.

TABLE 5

| | Main Additives (%) | | | | Rockwell Hardness (HRB) | |
|---|---|---|---|---|---|---|
| | Cu | Si | Mg | Zn | As Cast | Age Hardened |
| Reference Sample 1 | 3.3 | 14.0 | 0.8 | 0.8 | 40 | 50 |
| Reference Sample 2 | 3.3 | 14.0 | 1.4 | 0.8 | 62 | 70 |
| Inventive Sample 1 | 3.3 | 14.0 | 1.6 | 1.7 | 70 | 80 |

Die cast metals with the AC compositions listed in Table 4 (translator—meaning Table 5?) are prepared by simultaneously adding Mg and Zn to Al alloys containing 3.3% of Cu and 14.0% of Si. The resulting die cast metals with the AC compositions were tested for Rockwell hardness (B scale). (Hardness is designated as HRB).

Age hardening treatment takes place at 250° C. for approximately 20 minutes.

Reference Sample 1 This sample includes 0.8% of Mg and 0.8% of Zn and has the as-cast hardness (HRB) of 40 and post-age hardening treatment hardness (HRB) of 50.

Reference Sample 2 This sample includes 1.4% of Mg and 0.8% of Zn and has the as-cast hardness (HRB) of 62 and post-age hardening treatment hardness (HRB) of 70. This sample shows that an increased amount of Mg increases hardness.

Inventive Sample 1 This sample includes 1.6% of Mg and 1.7% of Zn and has the as-cast hardness (HRB) of 70 and post-age hardening treatment hardness (HRB) of 80. Increased amounts of Mg and Zn make this sample harder.

Following observations have been made on the age hardened charactertics of the various samples:

With the alloy of the Reference Sample 1, $CuAl_2$ is a primary intermetallic compound that determines the age hardening characteristics, while $Mg_2Si$ is a secondary intermetallic compound.

With the alloy of the Reference Sample 2, $CuAl_2$ and $Mg_2Si$ are both primary intermetallic compounds that determine the age hardening characteristics.

With the Inventive Sample 1, $CuAl_2$, $Mg_2Si$, and $MgZn_2$ are all primary intermetallic compounds that contribute to the age hardening effect. As a result, the inventive sample, with approximately the same amounts of Zn and Mg, offers very high hardness.

Because a piston moves back and forth at high speed in an internal combustion cylinder, the piston must not seize up in the cylinder. A chip-on-disk type abrasion tester was used for testing seizure characteristics using the following steps.

A rotating disk rotates at a rate of 16 m/sec, and drops of oil are added to this rotating disk at a rate of 240 $cm^3$/min. A test sample (die cast metal with the AC composition) is pressed against this rotating disk under a prescribed load for three minutes for preconditioning. Next, the supply of oil is stopped, and the test sample continues to be pressed against the rotating disk, rotating at a rate of 16 m/sec under a pressure P. Measurement is taken on the amount of time it takes for the sample to get seized on the rotating disk. Test results are recorded as the PV value ($kgf/mm^2 \times m/sec$) which is a product of pressure P ($kgf/mm^2$) and rate of rotation V (m/sec).

TABLE 6

| | Main Additives (%) | | | | Heat | Seizure Characteristics |
|---|---|---|---|---|---|---|
| | Cu | Si | Mg | Zn | Treatment | ($kgf/mm^2 \times m/sec$) |
| Inventive Sample 2 | 3.3 | 14.0 | 2.0 | 1.8 | T5 | 10 |
| Inventive Sample 3 | 3.3 | 13.0 | 1.4 | 1.6 | T5 | 5 |
| Reference Sample 3 | 3.3 | 13.0 | 0.8 | 0.6 | T5 | 3 |

The left half of Table 6 lists the compositions of Samples 2 and 3 of the present embodiment and Reference Sample 3, on which the seizure tests were performed. All test samples have been exposed to the T5 age hardening treatment.

FIG. 1 is a graph showing the seizure test results for the die cast metal of this invention. Inventive Sample 2 in this graph designates a curve that plots multiple points representing PV values at which Inventive Sample 2 shows seizure. Similar curves have been drawn for Inventive Sample 3 and Reference Sample 3. At 1200 seconds (20 minutes), the PV values are 10 for Inventive Sample 2, 5 for Inventive Sample 3, and 3 for Reference Sample 3.

These values, 10, 5, 3, respectively, have been entered into the right-hand column of Table 6. As shown in this Table, Inventive Sample 3, which includes 1.4% of Mg and 1.6% of Zn, shows superior seizure characteristics, compared with Reference Sample 3, which includes 0.8% of Mg and 0.6% of Zn. Inventive Sample 2, which includes 1.0% of Mg and 1.8% of Zn, offers even superior seizure characteristics. These results show that seizure characteristics are improved by adding appropriate amounts of Mg and Zn.

High temperature characteristics of the die cast metals of this invention were next examined.

TABLE 7

| | Main Additives (%) | | | | Heat | Time-Dependent Hardness Degradation |
|---|---|---|---|---|---|---|
| | Cu | Si | Mg | Zn | Treatment | at 240° C. |
| Inventive Sample 3 | 3.3 | 13.0 | 1.4 | 1.6 | T5 | Small |
| Reference Sample 4 (AC8B) | 2.0–4.0 | 8.5–10.5 | 0.5–1.3 | — | T7 | Large |

A significant aspect of this invention is that die cast metals with the AC composition are amenable to annealing. T5 age hardening treatment was performed on die cast metals having the composition shown in Table 7 for Inventive Sample 3.

T7 solution treatment followed by a stabilizing treatment was performed on the AC8B alloy (composition shown in Table 2) for Reference Sample 4.

Figure 2A:
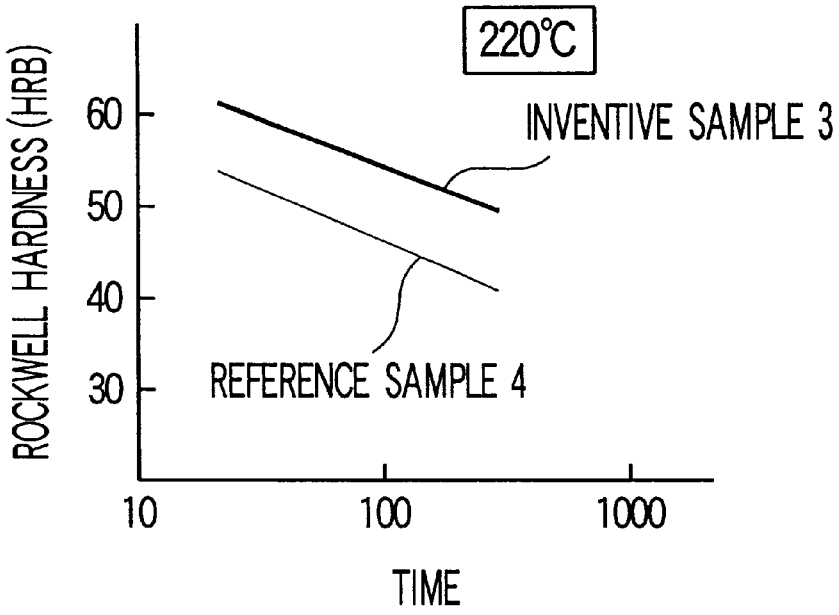
FIG. 2A and FIG. 2B are graphs showing relationships between temperature and hardness degradation over time
Figure 2B:
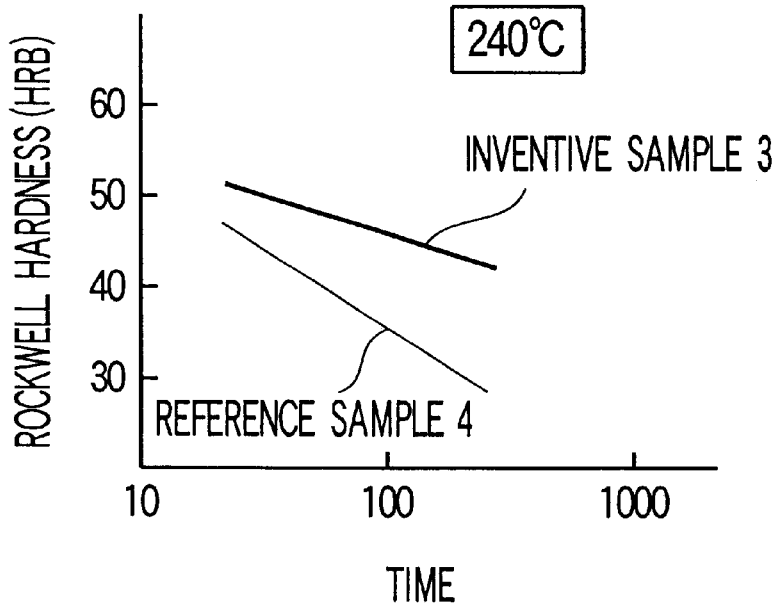

FIG. 2A and FIG. 2B are graphs showing relationships between temperature and time-dependent degradation in hardness. While the x-axis represents time, the y-axis represents Rockwell hardness (HRB).

FIG. 2A shows changes in hardness in Inventive Sample 3 and Reference Sample 4, when temperature is 220° C. Inventive Sample 3 of is always much harder than Reference Sample 4, which has gone through a T7 treatment.

FIG. 2B shows changes in hardness with Inventive Sample 3 and Reference Sample 4, when temperature is 240° C. Reference Sample 4 degrades much more than Inventive Sample 3. In other words, Inventive Sample 3 shows superior heat resistance characteristics. These results are shown in the right hand column of Table 7 under a column title "Time-Dependent Hardness Degradation at 240 degrees C." Entry for Sample 3 of this embodiment in this column is "Small," while entry for the Reference Sample 4 is "Large."

TABLE 8

| | | Reference Sample 5 (AC8A-T7) | Inventive Sample 3 |
|---|---|---|---|
| Coefficient of Thermal Expansion (Room Temperature to 100° C.) | | $19.2 \times 10^{-6}$–$20.8 \times 10^{-6}$ | $19.4 \times 10^{-6}$–$20.3 \times 10^{-6}$ |
| Thermal Conductance (cal/cm* sec ° C.) | | $0.32 \times 10^{-6}$–$0.34 \times 10^{-6}$ | $0.24 \times 10^{-6}$–$0.25 \times 10^{-6}$ |
| Young's Module ($kg/mm^2$) | | 7500–7900 | 7620 |
| Density ($g/cm^3$) | | 2.27 | 2.26–2.71 |
| Hardness (HRB) | | 64–68 | 68–82 |
| Tensile Strength ($kgf/mm^2$) | 200° C. | 2.16–26.5 | 23.5–28.6 |
| | 300° C. | 7.5 | 13.2–14.5 |
| 0.2 % Yield Strength ($kgf/mm^2$) | 200° C. | 20.2–20.9 | 20.3–24.5 |
| | 300° C. | 5.8 | 10.2–12.1 |
| High-Temperature Fatigue Strength ($kgf/mm^2$) | 200° C. | 7.5–8.0 | 8.5–9.0 |
| | 300° C. | 3.4 | 4.3 |

Table 8 compares various characteristics of Inventive Sample 3, as shown in Table 7, against Reference Sample 5 (AC8A-T7). Inventive Sample 3 shows comparable or superior characteristics with respect to the Reference Sample 5 in terms of tensile strength, 0.2% yield strength, and high temperature fatigue strength. In other words, Inventive Sample 3 (a die cast metal with T5 age hardening treatment) is comparable to the T7 treated (515° C. for four hours of solution treatment and 230° C. for five hours of stabilization treatment) AC8A alloy, which is a superior Al alloy cast metal in terms of heat resistance and widely used for pistons and other applications.

Next, pistons manufactured with the die cast metal having the AC composition of this invention were built into engines to evaluate the seizure characteristics.

Tests were performed on engines with 580 $cm^3$ capacity. 380 $cm^3$ of oil is added to the engine at the time when the engine starts. As the engine runs, 10–20 $cm^3$ of engine oil is drained every 10 minutes. The engine starts to seize up, when the amount of engine oil is much lower than the minimum required amount or close to zero. If the piston offers superior seizure characteristics, there would be extra time before seizure starts. The results of this test are recorded in terms of the amount of the engine oil remaining when the engine stops running due to seizure.

TABLE 9

| | Main Additives (%) | | | | Heat Treatment | Amount of Oil Remaining at the Time of Seizure | Size of Damages on Piston Caused by Seizure |
|---|---|---|---|---|---|---|---|
| | Cu | Si | Mg | Zn | | | |
| Inventive Sample 4 | 3.3 | 13.0 | 1.6 | 1.7 | T5 | 58 $cm^3$ | Small |
| Reference Sample 6 (AC8A) | 0.8–1.3 | 11.0–13.0 | 0.7–1.3 | — | T7 | 70 $cm^3$ | Large |

Inventive Sample 4, which is a die cast metal of this invention undergoing the T5 treatment, showed 58 $cm^3$ of remaining engine oil. Only small seizure damages were observed on the surface of the piston, when the engine was taken apart. On the other hand, Reference Sample 6, representing the AC8A-T7 alloy, showed 70 $cm^3$ of remaining engine oil. Large seizure damages were observed on the surface of the piston, when the engine was taken apart. These results show that a piston consisting of the T5 treated die cast metal, having the AC composition, offers superior seizure characteristics compared with a piston consisting of the conventional AC8A-T7 alloy.

According to the JIS, Si content in the gravity die cast and annealed AC8A alloy must be at least 11.0% (see Table 2). When the same type of alloy is die cast, Si concentration in the primary crystals and eutectic cells ends up being approximately 1.5% lower than the gravity die cast and treated AC8A alloy, because of rapid cooling and solidification during the die cast process. In other words, approximately 1.5% of Si apparently "disappears," because of the die cast process.

To address this issue, the die cast metal of this invention must have at least 12.5% of Si, which is comparable to 11.0% plus 1.5%. Because excessive amount of Si would adversely impacts toughness of the alloy, the die cast metal of this invention must have less than 14.0% of Si. In other words, Si content in this invention ranges between 12.5% to 14.0%.

When Cu content is less than 3.0%, the resulting die cast metal does not offer adequate hardness initially after cooling. Furthermore, the metal will not harden adequately underage hardening. When Cu content is more than 4.5%, the resulting metal becomes less tough, creating a problem for machining. For these reasons, Cu content should be 3.0% to 4.5%.

Similar to Cu, when Mg content is less than 1.4%, the resulting metal does not harden adequately under age hardening. When Mg content is more than 2.0%, the resulting metal is less tough and causes a problem with machining. For these reasons, Mg content should be between 1.4% and 2.0%.

When Zn content is less than 1.12%, the resulting die cast metal becomes prone to cracks. When Zn content is more than 2.4%, the resulting metal is less tough. For these reasons, Zn content should be between 1.12% and 2.24%.

In summary, the heat resistant Al die cast material of this invention is an Al—Si—Cu die cast alloy having 12.5% to 14.0% of Si, 3.0% to 4.5% of Cu, 1.5% to 2.0% of Mg, and 1.12% to 2.4% of Zn.

Furthermore, the Al die cast metal of this invention may include trace amounts of Fe, Mn, Ni, and other elements.

While the heat resistant Al die cast material of this invention is suited for pistons, the material may also be widely used in other applications that require light weight, heat resistant, abrasion resistant materials.

The present disclosure relates to the subject matter of Japanese Patent Application No. 2001-094368, filed Mar. 8, 2001, the disclosure of which is incorporated herein by reference in its entirety.

What is claimed is:

1. A heat-resistant die cast Al alloy consisting essentially of: Al, 12.5% to 14.0% of Si, 3.0% to 4.5% of Cu, 1.4% to 2.0% of Mg, and 1.12% to 2.4% of Zn; wherein the alloy is age hardened after die casting.

2. A heat-resistant die cast Al alloy according to claim 1; wherein the Mg and Zn are added simultaneously with the other elements.

3. A heat-resistant die cast Al alloy according to claim 1; wherein Mg and Zn are added in substantially equal amounts.

4. A heat-resistant die cast Al alloy according to claim 1; wherein the concentration of Zn is 80% to 120% of the concentration of Mg.

5. A heat-resistant die cast Al alloy according to claim 1; wherein the age hardening is a T5 age hardening treatment.

6. A heat-resistant die cast Al alloy according to claim 1; wherein the age hardening comprises annealing.

7. A heat-resistant die cast Al alloy according to claim 1; wherein no more than trace amounts of Fe, Mn or Ni are included in the alloy.

8. A heat-resistant die cast Al alloy according to claim 1; wherein $CuAl_2$, $Mg_2Si$ and $MgZn_2$ are primary intermetallic compounds that provide an age hardening effect during the age hardening.

9. A heat-resistant die cast Al alloy according to claim 1; wherein Mg is included in the range of 1.5% to 2.0%.

10. A heat-resistant die cast Al alloy according to claim 9; wherein Cu is included in the range of 3.0% to 4.0%.

11. A heat-resistant die cast Al alloy according to claim 10; wherein Zn is included in the range of 1.12% to 2.0%.

12. A heat-resistant die cast Al alloy consisting essentially of: 12.5% to 14.0% of Si, 3.0% to 4.5% of Cu, 1.5% to 2.0% of Mg, and 1.12% to 2.4% of Zn, wherein said Si, Cu, Mg, and Zn amounts are sufficient to ensure that $CuAl_2$, $Mg_2Si$ and $MgZn_2$ are primary intermetallic compounds that provide an age hardening effect during age hardening of the alloy.

13. A heat-resistant die cast Al alloy according to claim 12; wherein the alloy is age hardened after die casting.

14. A heat-resistant die cast Al alloy according to claim 13; wherein the age hardening is a T5 age hardening treatment.

15. A heat-resistant die cast Al alloy according to claim 13; wherein the age hardening comprises annealing.

16. A heat-resistant die cast Al alloy according to claim 12; wherein no more than trace amounts of Fe, Mn or Ni are included in the alloy.

17. A heat-resistant die cast Al alloy according to claim 12; wherein the Mg and Zn are added simultaneously with the other elements.

18. A heat-resistant die cast Al alloy according to claim 12; wherein Mg and Zn are added in substantially equal amounts.

19. A heat-resistant die cast Al alloy according to claim 12; wherein the content of Zn is 80% to 120% of the content of Mg.

20. A heat-resistant die cast Al alloy according to claim 12; wherein the alloy is an AC type alloy.

* * * * *